US007803035B2

(12) United States Patent
Nauche et al.

(10) Patent No.: US 7,803,035 B2
(45) Date of Patent: Sep. 28, 2010

(54) METHOD AND A DEVICE FOR WORKING THE PERIPHERY OF AN OPHTHALMIC LENS FOR EYEGLASSES

(75) Inventors: Michel Nauche, Charenton-le-Pont (FR); Gaël Mazoyer, Charenton-le-Pont (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 496 days.

(21) Appl. No.: 11/919,422

(22) PCT Filed: Mar. 22, 2006

(86) PCT No.: PCT/FR2006/000625

§ 371 (c)(1),
(2), (4) Date: Dec. 12, 2007

(87) PCT Pub. No.: WO2006/117443

PCT Pub. Date: Nov. 9, 2006

(65) Prior Publication Data

US 2009/0305614 A1 Dec. 10, 2009

(30) Foreign Application Priority Data

Apr. 29, 2005 (FR) ..... 05 04358

(51) Int. Cl.
*B24B 9/14* (2006.01)

(52) U.S. Cl. ..... 451/5; 451/43

(58) Field of Classification Search ..... 451/5, 451/42, 43, 256, 255, 541
See application file for complete search history.

(56) References Cited

U.S. PATENT DOCUMENTS 4,171,926 A 10/1979 Dusza
2004/0058624 A1 3/2004 Suzuki et al.

FOREIGN PATENT DOCUMENTS

EP 1 260 313 11/2002
FR 2 811 599 1/2002

*Primary Examiner*—Robert Rose
(74) *Attorney, Agent, or Firm*—Young & Thompson

(57) ABSTRACT

A method of working the periphery of an ophthalmic lens (L), the periphery of the lens possessing an edge face (C) and the method including edging the edge face of the lens by machining with a first grindwheel (31) mounted to rotate about an axis of rotation (A4). According to the invention, during the edging, in addition to being free to rotate about the axis of rotation, the first grindwheel possesses two degrees of freedom to move in tilting about two distinct pivot directions that are substantially transverse to its axis of rotation.

21 Claims, 4 Drawing Sheets

METHOD AND A DEVICE FOR WORKING THE PERIPHERY OF AN OPHTHALMIC LENS FOR EYEGLASSES

TECHNICAL FIELD TO WHICH THE INVENTION RELATES

The present invention relates in general to mounting the ophthalmic lenses of a pair of correcting eyeglasses in a frame, and it relates more particularly to a method and to a tool for working the periphery of an ophthalmic lens of a pair of eyeglasses, and also to a device for shaping an ophthalmic lens that incorporates such a work tool.

A particularly advantageous application of the invention lies in restarting the edging of the edge face of a lens after a first machining operation.

TECHNOLOGICAL BACKGROUND

Shaping a lens to enable it to be mounted in or on a frame selected by the future wearer consists in modifying the outline of the lens so as to adapt it to the frame and/or to the shape desired for the lens. Shaping the lens includes edging in order to shape the periphery of the lens, and, depending on whether the frame is of the rimmed type (the frame having rims presenting an internal bezel forming a groove), of the drilled type (with a rimless frame and point connections through fixing holes formed in the lens), or of the grooved type (with a frame possessing firstly two half-rims each presenting a bevel or a bezel as in rimmed frames, and secondly a nylon string passing around the remainder of the outline of the lenses), shaping also involves appropriately beveling or grooving the lens, and/or drilling it. With a drilled type frame, after being shaped, the lens is drilled at fastener points for the nose bridge either using the same shaper device or else using a separate appliance.

Edging proper consists in eliminating the superfluous peripheral portion of the ophthalmic lens in question so as to transform its initial outline, which is usually circular, to the outline desired for the rim of the frame of the eyeglasses in question, or merely to the desired shape when the frame is of the rimless type. This edging operation is usually followed by a chamfering operation which consists in rounding or chamfering the two sharp edges at the edge of the edge lens. When the frame is of the rimmed type, this chamfering is accompanied or preceded by a beveling operation which consists in forming a rib usually called a bevel and generally of triangular cross-section on the edge face of the ophthalmic lens. This bevel is designed to be engaged in a corresponding groove, commonly referred to as a bezel, formed in the rim of the frame in which the lens is to be mounted. When the frame is of the rimless type, the operations of shaping the lens and optionally rounding its sharp edges (chamfering) are followed by appropriately drilling the lenses so as to enable the branches (temples) and the nose bridge of a rimless frame to be fastened. Finally, when the frame is of the type that has a nylon string, chamfering is accompanied by grooving which consists in forming a groove in the edge face of the lens, this groove serving to receive the nylon string of the frame for pressing the lens against the rigid portion of the frame.

Conventionally, such shaper means are constituted by a machine tool referred to a grinder that possesses a set of main grindwheels and means for blocking and imparting rotary drive to the lens, which means are constituted by two rotary shafts lying on the same axis and mounted to move relative to each other in an axial direction in order to clamp the lens on said axis between them. In order to enable the lens to be moved towards or away from the grindwheels during machining, the clamping and drive shafts are carried by a rocker that is movable (in pivoting or translation) transversely relative to the shafts.

As a general rule, the operations of shaping, chamfering, and beveling are performed in succession on a single grinder that is fitted with a suitable set of main grindwheels. Drilling, when required, can be performed on the same grinder, which then needs to be fitted with corresponding tooling, or else on a distinct drilling machine.

The optician needs also to perform a certain number of measurement and/or identification operations on the lens itself, prior to shaping, in order to identify certain characteristics of the lens such as, for example: its optical center if it is a single vision lens, or the mounting cross if it is a progressive lens, or the direction of the progression axis and the position of the centering point of a progressive lens.

In practice, each lens is generally delivered by the manufacturer with marks on its concave front face, some of which marks identify a centering frame of reference for the lens. If these marks on the ophthalmic lens themselves are not sufficiently visible, the optician marks certain characteristic points using a marker tip. These marks are used for positioning and fastening an adapter or centering-and-drive pad on the lens so as to enable the ophthalmic lens to be positioned properly in the machine tool that is to give it the desired outline corresponding to the shape of the selected frame. The operation of positioning and depositing the pad can be performed manually or automatically, using an appliance referred to as a centering and blocking device.

In any event, the pad is usually stuck temporarily on the lens with the help of a double-sided adhesive. This operation is conventionally referred to as centering the lens, or by extension blocking the lens, insofar as the pad enables the lens subsequently to be blocked, i.e. prevented from moving, on the means for shaping it and in a geometrical configuration that is known by virtue of the pad.

After the centering pad has been put into place, the lens fitted therewith is subsequently placed in the shaper machine where it is given the shape that corresponds to the shape for the selected frame. The centering pad serves to define and to physically employ on the lens a geometrical frame of reference in which characteristic points and directions of the lens are identified together with shaping values, as are needed for making the lens coincide with the position of the pupil, so as to ensure that these characteristic points and directions are properly positioned in the frame.

When the first attempt at shaping the lens does not succeed in enabling it to be properly mounted in the frame, the operator restarts machining. To do this, the lens is put back in the machine and is blocked using the same pad, thus enabling the initial frame of reference used for shaping to be recovered.

Nevertheless, the use of a stuck-on pad constitutes a drawback insofar as the pad needs to be removed after the lens has been mounted, thereby consuming time and labor. In addition, the lens is secured to the pad by adhesive, which can require intensive cleaning of the surface of the lens after the treatment, running the risk of scratches. Finally, since these operations of placing and removing the pad are relatively complex and difficult, they must be performed by qualified and careful personnel, which in practice consumes a large amount of time and is thus expensive; for the same reasons, these operations turn out to be difficult to automate.

Thus, in the context of its research work, the Applicant is seeking to avoid centering by means of a pad because of the above-mentioned constraints.

However, under such circumstances, in which a pad is no longer put into place prior to the first machining operation, the lens is centered and blocked on the clamping-and-drive shafts by optical measurement means and/or mechanical handler means. Optical measurements provide a theoretical centering frame of reference for the ophthalmic lens relative to the clamping shafts. Inaccuracies in centering and blocking the lens, and also in the measurement and handler means, have the effect that a first real frame of reference is obtained for the lens relative to the clamping shafts that is slightly different from the theoretical frame of reference calculated from the optical measurements. The first machining operation is performed in this first real frame of reference.

The lens is then shaped by machining using cylindrical roughing-out and finishing grindwheels whose shaping faces are parallel to the axis of rotation of the clamping-and-drive shafts, said grindwheels forming part of a main grindwheel set and being mounted to rotate about the axis of rotation of the grindwheel set.

After the first machining operation, the lens is unblocked, and is therefore separated from the blocking chucks of the clamping shafts. As a result of this unblocking, the first real centering frame of reference is lost.

When previous shaping of the lens in a first machining operation does not produce the desired result, the optician needs to restart shaping in a second machining operation.

In order to restart machining correctly, the lens ought to be placed in the real centering frame of reference that was used during the first machining operation so that the edging face of the working grindwheel is indeed parallel to the edge face of the lens for reworking.

Prior to the second machining operation, optical measurements are used to recalculate the theoretical centering frame of reference for the lens. Inaccuracies in these optical measurements mean that the real centering frame of reference obtained in the second machining step differs slightly from the theoretical first frame of reference used during the first machining step. Furthermore, these optical measurement inaccuracies are in addition to inaccuracies in blocking the lens by the blocking chucks on the clamping shafts. The second real centering frame of reference that is actually obtained is thus different from the first in which it would be desirable for the lens to be replaced for reworking. This leads to an error in the positioning of the lens relative to the grindwheel during this second machining operation. In particular, the lens is off-center relative to its center position during the first machining operation, so the edge face of the lens is inclined relative to the edging face of the working grindwheel. Thus, machining in this configuration cannot obtain the desired radii of curvature in the edge face of the lens.

Furthermore, if the lens includes a bezel, the error in the positioning of the lens relative to the grindwheel means that when restarting machining the edging face of the grindwheel pares away the bezel in non-symmetrical manner.

The problem thus lies in restarting edging in the new centering frame of reference of the ophthalmic lens for eyeglasses in such a manner as to enable the edge face of the lens to be machined again correctly.

Document FR 2 811 599 describes a chamfering tool for improving the accuracy of a chamfering operation applied to a lens for eyeglasses. However that invention neither poses nor solves the technical problem of restarting edging in the new centering frame of reference of the lens.

It proposes inserting compensation means having the capacity to deform elastically between firstly the periphery in question of one or other of the elements constituting the chamfering tool used and the eyeglasses lens being worked, and secondly the support shaft for the same element.

However nothing is said concerning the use of such a tool for restarting edging of the edge face of an ophthalmic lens. The structural characteristics of the tool described do not lend themselves to such transposition. The chamfering tool does not have a face for edging the edge face of the lens.

In addition, the tool does not satisfy accuracy requirements for restarting edging the edge face of the lens and it cannot satisfy those requirements since the inserted compensation means leave the chamfering tool free to deform radially.

SUMMARY OF THE INVENTION

The object of the present invention is to restart machining of the edge face of the lens correctly in spite of the lens being positioned erroneously relative to the machining grindwheel due to unwanted tilting that occurs during a second operation of blocking the lens in the clamping shafts of the shaper device, after the centering frame of reference of the lens has been lost.

To this end, the invention provides a method of working the periphery of an ophthalmic lens, the periphery of the lens possessing an edge face and the method including edging the edge face of the lens by machining with a first grindwheel mounted to rotate about an axis of rotation, in which, during the edging, in addition to the first grindwheel being free to rotate about said axis of rotation, provision is made for it to possess two degrees of freedom to move in tilting about two distinct pivot directions that are substantially transverse to its axis of rotation.

The invention also provides a tool for working the periphery of an ophthalmic lens, the tool comprising a support and a first grindwheel mounted on the support, the first grindwheel presenting an edging face that is circularly symmetrical about an axis of symmetry, in which tool the first grindwheel is mounted on the support by tilting mechanical connection means enabling the first grindwheel to pivot relative to the support about two distinct pivot directions that extend substantially transversely relative to the axis of symmetry of the edging face of the first grindwheel.

Finally, the invention provides a shaper device for shaping an ophthalmic lens, the device having shafts for clamping and imparting rotary drive to the ophthalmic lens, main grindwheels, and a work tool as specified above.

Thus, while edging the edge face at the periphery of the lens, because of its two degrees of freedom about two distinct pivot directions in accordance with the invention, the first grindwheel is capable of tilting so as to adapt to the local orientation of the edge face of the lens. This adaptable orientation of the grindwheel serves to compensate for the unwanted tilting of the lens that arises as a result of it being blocked a second time in the lens clamping shafts, and thus makes it possible to machine the edge face of the lens correctly.

In a first advantageous characteristic of the invention, the freedom to move in tilting of the first grindwheel is freedom of the radially-rigid, spherical type. Thus, edging is always performed to the correct dimension and enables the various radii describing the outline of the shape desired for the lens to be reproduced accurately.

In a second advantageous characteristic of the invention, the tool is placed on a module of the ophthalmic lens shaper device, which module is retractable in a plane extending substantially transversely to the axis of the clamping-and-rotary drive shafts for the ophthalmic lens.

In a third advantageous characteristic of the invention, the first grindwheel is returned in its pivoting about its pivot directions towards a return position. Thus, the edging face of the first grindwheel remains pressed against the edge face of the lens for machining, and the edging face and the edge face are correctly positioned relative to each other.

In a fourth advantageous characteristic of the invention, the support constitutes a shaft for driving the first grindwheel and having an axis of rotation that coincides substantially with the axis of symmetry of the edging face of the first grindwheel, drive means being provided for transmitting torque from the shaft to the first grindwheel. The drive means then coincide with the tilting mechanical connection means and they are arranged to provide a spherical mechanical connection with a finger. Thus, the drive and tilting system for the first grindwheel is compact.

In a fifth advantageous characteristic of the invention, the means for driving the first grindwheel are distinct from the tilting mechanical connection means. Thus, the functions of driving the first grindwheel in rotation and of tilting it are decoupled.

In a sixth advantageous characteristic of the invention, the method is adapted to restarting the edging of the edge face of the lens after a first machining operation. The method then advantageously includes the following preliminary steps:

before the first machining operation, the lens is centered and blocked in a first centering frame of reference;

after the first machining operation, the lens is unblocked and the centering frame of reference lost; and before the second machining operation, the lens is centered and blocked again. It is then possible to restart edging the edge face of the lens with the first grindwheel in spite of the error in the positioning of the lens relative to the grindwheel.

The method is thus indeed applicable after shaping steps have been performed by the optician, and in particular when, after a first machining operation, the ophthalmic lens does not mount in satisfactory manner in the frame and it is necessary to restart edging the edge face of the lens.

In a seventh advantageous characteristic of the invention, the first grindwheel possesses a beveling groove in its edging face. Thus, the method is applied to restarting the edging of the edge face of a lens that includes a bevel.

In an eighth advantageous characteristic of the invention, the first grindwheel includes a chamfering face with a generator line that forms an angle relative to the edging face. Thus, the first grindwheel can perform the operation of chamfering the sharp edges at the edge of the lens.

DETAILED DESCRIPTION OF AN EMBODIMENT

The description below with reference to the accompanying drawings of various embodiments, given as non-limiting examples, shows clearly what the invention consists in and how it can be implemented.

Figure 2:
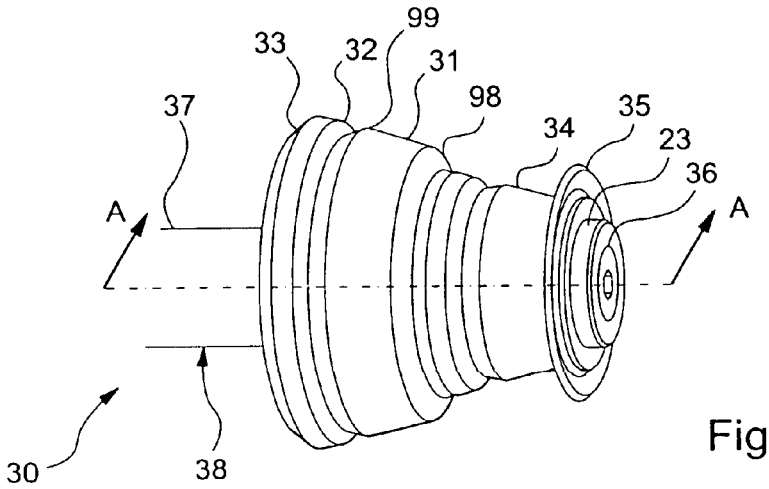
FIG. 2 shows a detail of FIG. 1 identified by arrow II in FIG. 1, seen from another angle and on a larger scale, showing the tool of the invention for working the periphery of the ophthalmic lens, showing the first grindwheel and other grindwheels and disks for working the periphery of the lens.
Figure 4:
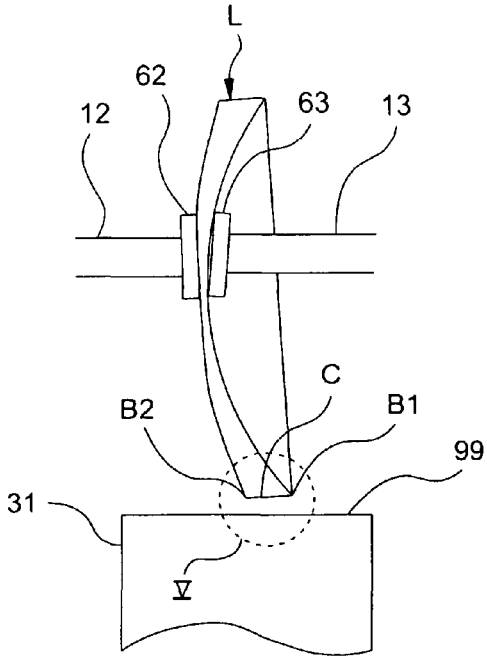
FIG. 4 is a diagrammatic view of the ophthalmic lens and of its clamping shafts showing a departure in the positioning, with unwanted tilting relative to the first grindwheel.
Figure 5:
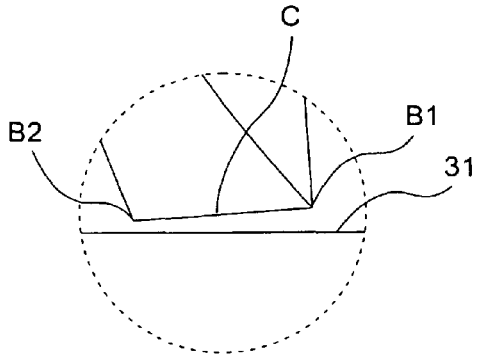
Figure 6:
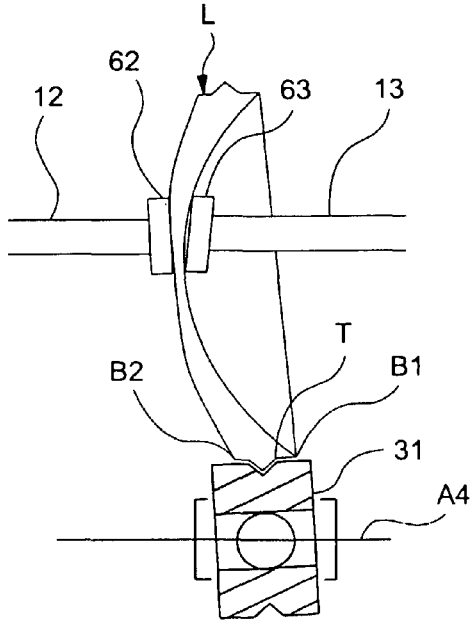
Figure 7:
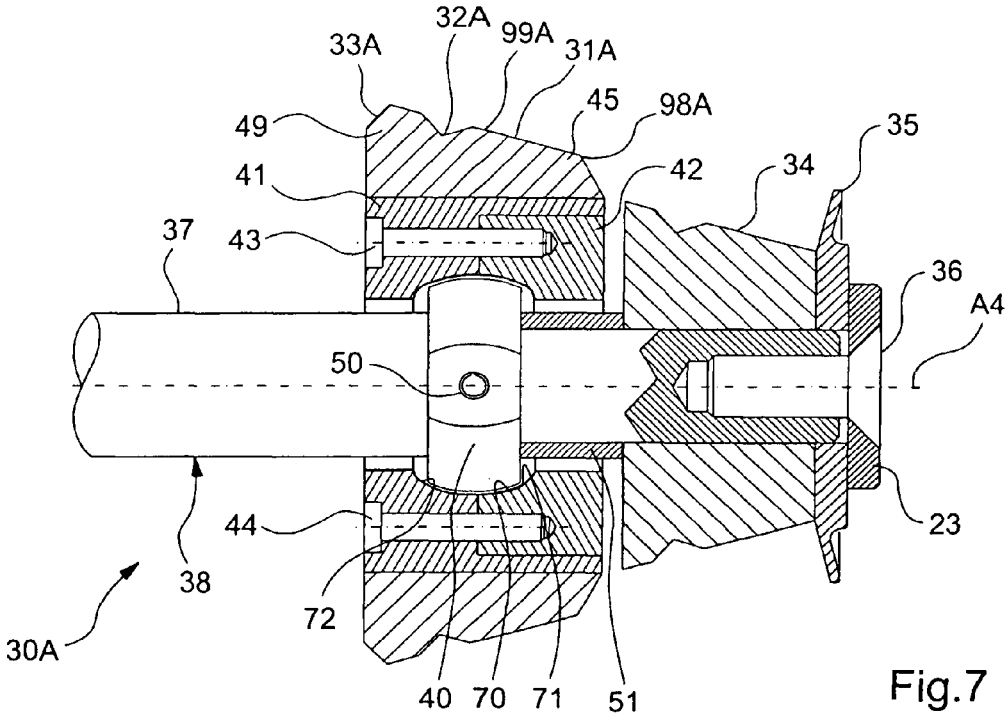
Figure 8:
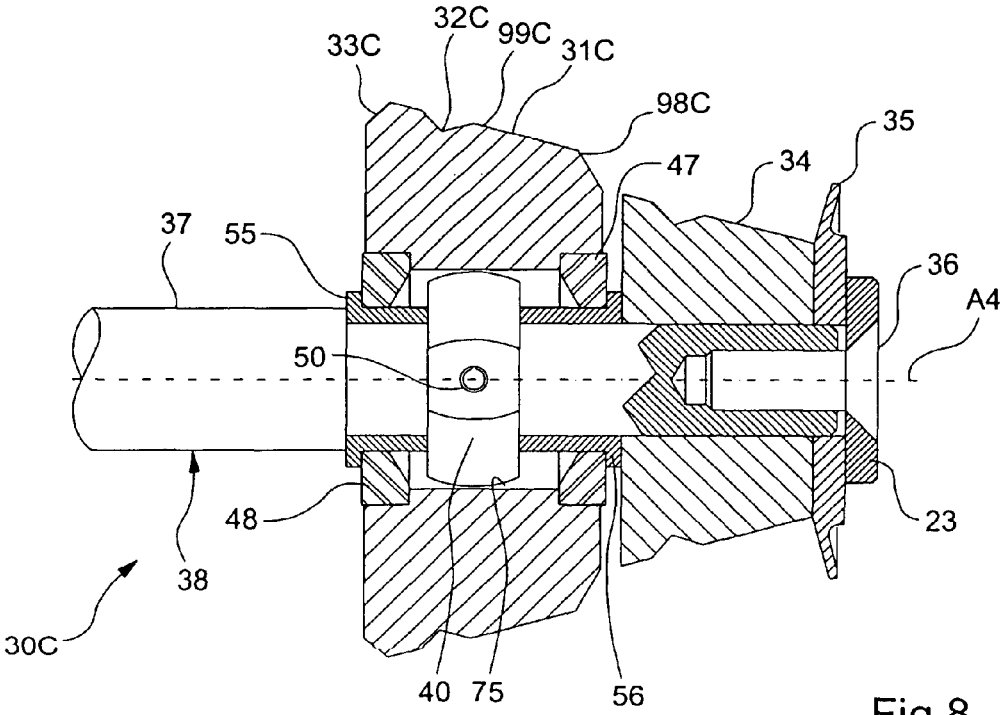
Figure 9:
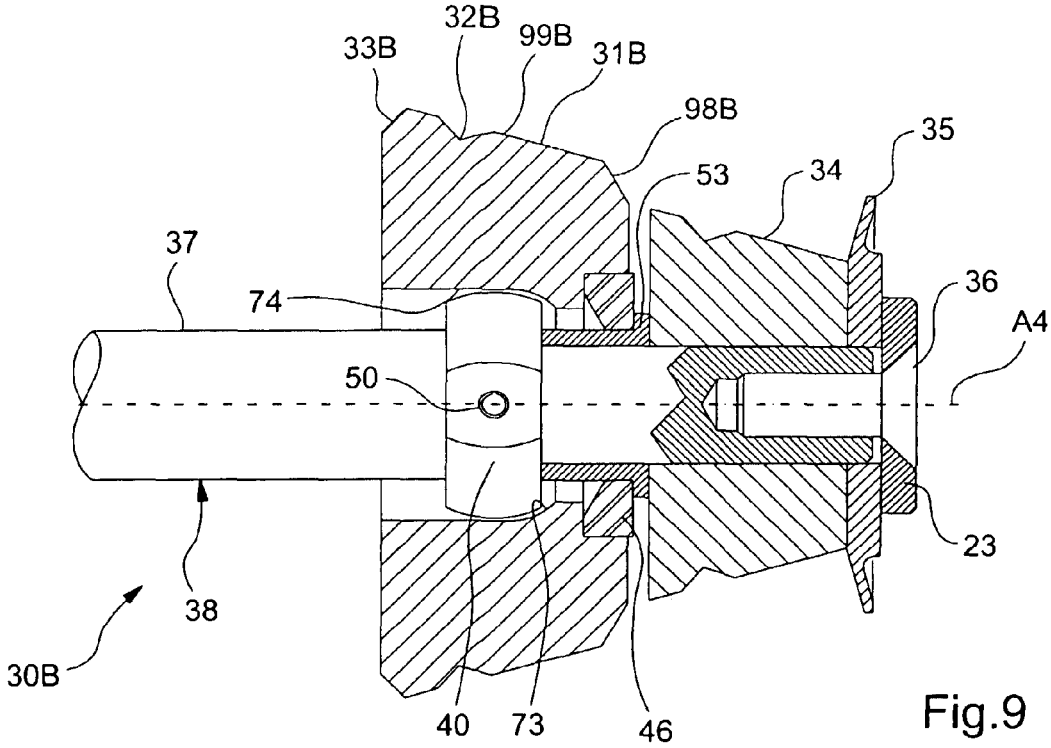
Figure 10:
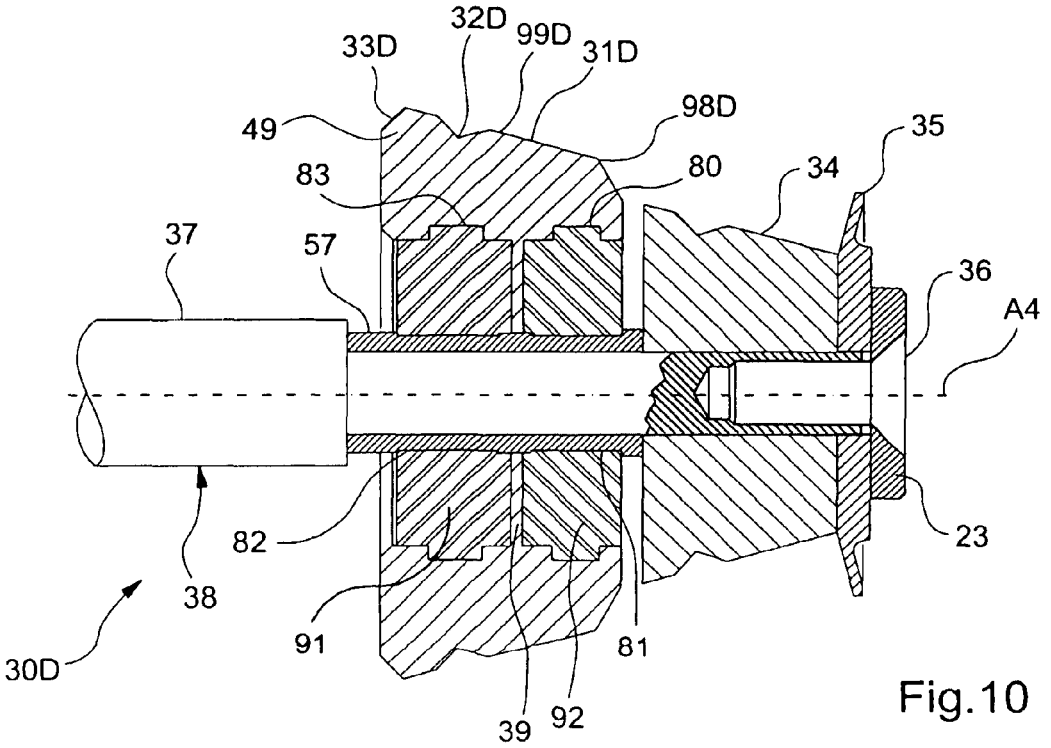

FIG. 5 reproduces a detail of FIG. 4 identified by an arrow V in FIG. 4 on a larger scale, showing the departure in the positioning of the lens relative to the reworking grindwheel;

FIG. 6 is a diagram showing the principle of the first grindwheel being mounted via a spherical mechanical connection in accordance with the invention;

FIG. 7 is an axial section view of FIG. 2, showing the tool for working the periphery of the ophthalmic lens constituting a first embodiment of the invention;

FIG. 8 is an axial section view of FIG. 2, showing the tool for working the periphery of the ophthalmic lens constituting a second embodiment of the invention;

FIG. 9 is an axial section view of FIG. 2, showing the tool for working the periphery of the ophthalmic lens constituting a third embodiment of the invention; and FIG. 10 is an axial section view of FIG. 2, showing the tool for working the periphery of the ophthalmic lens constituting a fourth embodiment of the invention.

Figure 1:
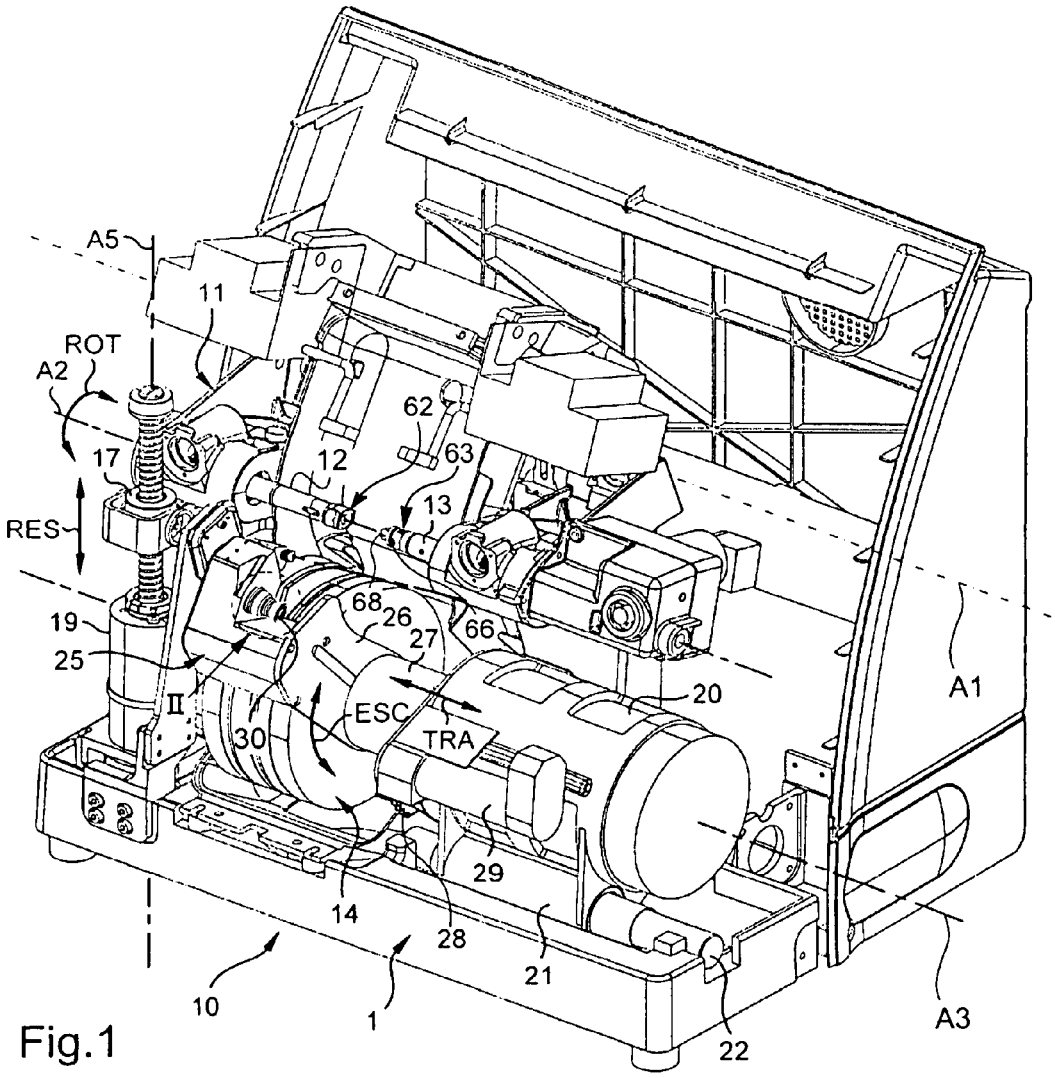
FIG. 1 is a diagrammatic general view in perspective of a shaper device fitted with a tool in accordance with the invention for working the periphery of an ophthalmic lens.

FIG. 1 shows a shaper device 10 for implementing a method of working the periphery of an ophthalmic lens L for eyeglasses.

The shaper device 10 of the invention can be implemented in the form of any machine for cutting away or removing material and that is adapted to modifying the outline of the ophthalmic lens L so as to adapt it to the rim of a selected frame. Such a machine may be constituted, for example, by a grinder, as in the example described, but it could also be constituted by a mechanical, laser, or water-jet cutter, etc.

In the example shown diagrammatically in FIG. 1, the shaper device 10 comprises in conventional manner an automatic grinder, commonly said to be numerically controlled. Specifically, this grinder includes a rocker 11 that is mounted on a frame 1 to pivot freely about a first axis A1, in practice a horizontal axis.

To hold and rotate an ophthalmic lens such as L for machining, the grinder is fitted with two clamping and rotary drive shafts 12 and 13. These two shafts are in alignment with each other on a second axis A2, known as the "blocking" axis, and parallel to the first axis A1. The two shafts 12 and 13 are driven to rotate synchronously by a motor (not shown), via a common drive mechanism (not shown) on board the rocker 11. This common mechanism for synchronous rotary drive is of the usual type and is known in itself.

In a variant, provision could also be made to drive the two shafts by two distinct motors that are synchronized mechanically or electronically.

The rotation ROT of the shafts 12 and 13 is controlled by a central electronic and computer system (not shown) such as an integrated microcomputer or a set of dedicated integrated circuits.

Each of the shafts 12, 13 has a free end facing the free end of the other shaft and fitted with a blocking chuck 62, 63. Both blocking chucks 62 and 63 are generally bodies of revolution about the axis A2, and each of them presents an application face (not shown) extending generally transversely that is arranged to bear against the corresponding face of the ophthalmic lens L.

In the example shown, the chuck 62 is a single piece and is fastened without any freedom of movement whether in sliding or in rotation on the free end of the shaft 12. In contrast, the chuck 63 comprises two portions: an application pellet 66 for co-operating with the lens L and carrying for this purpose a working face (not shown) and a shank (not shown) arranged to co-operate with the free end of the shaft 13, as described in greater detail below. The pellet 66 is attached to the shank 67 by a cardan connection 68 that transmits rotation about the axis A2, but that also allows the pellet 66 to swivel about any axis perpendicular to the axis A2. The working faces (not shown) of the chucks are preferably covered in a thin covering of plastics material or of elastomer material. The thickness of this covering is of the order of 1 millimeter (mm) to 2 mm. It may be constituted by a flexible polyvinylchloride (PVC) or by a neoprene.

The shaft 13 is movable in translation along the blocking axis A2, facing the other shaft 12 so as to perform clamping by applying axial compression on the lens L between the two blocking chucks 62 and 63. The shaft 13 is controlled to perform this axial movement by a drive motor acting via an actuator mechanism (not shown) under the control of the central electronic and computer system. The shaft 12 is unmoving in translation along the blocking axis A2.

The shaper device 10 also comprises a set of grindwheels 14 mounted to rotate about a third axis A3 parallel to the first axis A1, and likewise suitably driven in rotation by a motor 20.

In practice, the shaper device 10 includes a set of several grindwheels 14 mounted coaxially on the third axis A3 for roughing-out and finishing the edging of the ophthalmic lens L that is to be machined. Each of these various grindwheels is adapted to the material of the lens L being shaped and to the type of operation it is to perform (roughing-out, finishing, inorganic or synthetic material, etc.).

The set of main grindwheels 14 is fitted on a common shaft of axis A3 that drives the grindwheels in rotation during an edging operation. The common shaft (not shown in the figures) is driven by the electric motor 20 under the control of the electronic and computer system.

The set of main grindwheels 14 is also movable in translation along the axis A3 and its movement in this translation is controlled by a computer-controlled motor. Specifically, the entire set of main grindwheels 14, together with its shaft and its motor is carried by a carriage 21 that is itself mounted on slides 22 secured to the structure 1 to slide along the third axis A3. The movement in translation of the grindwheel-carrier carriage 21 is referred to as "transfer" and is referenced TRA. This transfer is controlled by a motor-driven drive mechanism (not shown) such as a rack or a screw-and-nut system, itself under the control of the central electronic and computer system.

To enable the spacing between the axis A3 of the grindwheels 14 and the axis A2 of the lens L to be adjusted dynamically during edging, use is made of the ability of the rocker 11 to pivot about the axis A1. This pivoting produces a displacement, in this example substantially vertically, of the lens L as clamped between the shafts 12 and 13, thereby moving the lens L towards or away from the grindwheels 14. This movement that makes it possible to reproduce the desired edging shape as programmed in the electronic and computer system is referred to as reproduction and is referenced RES in the figures. This reproduction movement RES is controlled by the central electronic and computer system.

As shown in FIG. 1, the rocker 11 is hinged directly to the nut 17 mounted to move along the reproduction axis A5. A strain gauge is associated with the rocker to measure the machining advance force applied to the lens L. The grinding advance force applied to the lens L is thus measured continuously throughout machining and the advance of the nut 17 and thus of the rocker 11 is controlled to ensure that this force remains below a set maximum value. For each lens L, this set value is adapted to the material and to the shape of the lens L.

To machine the ophthalmic lens L so as to have a given outline, it thus suffices firstly to move the nut 17 accordingly along the fifth axis A5 under the control of the motor 19 so as to control the reproduction movement, and secondly to cause the support shaft 12 and 13 to pivot simultaneously about the second axis A2, in practice under the control of their control motor. The transverse reproduction movement RES of the rocker 11 and the rotary movement ROT of the shafts 12 and 13 holding the lens L are controlled in coordination by an electronic and computer system (not shown) that is suitably programmed for this purpose, so that all of the points on the outline of the ophthalmic lens L are brought in succession to the appropriate diameter. Simultaneously, transfer TRA is controlled by the electronic system so as to cause the grindwheels to track the bevel, the groove, or the chamfer in an axial direction.

The grinder also has a finishing module 25 that is movable with one degree of freedom in a direction extending substantially transversely relative to the axis A2 of the shafts 12, 13 for holding the lens L and also relative to the axis A5 for reproduction RES. This degree of freedom in movement is referred to as retraction and is referenced ESC in the figures.

Specifically, this retraction consists in pivoting the finishing module 25 about the axis A3. Concretely, the module 25 is carried by a lever 26 secured to a tubular sleeve 27 mounted on the carriage 21 to pivot about the axis A3. To control its pivoting, the sleeve 27 is provided, at its end opposite from the lever 26, with a toothed wheel 28 that meshes with a gearwheel (not shown in the figures) fitted on the shaft of an electric motor 29 secured to the carriage 21.

In summary, the following degrees of freedom in movement can be seen to be available on such a shaping grinder:

- rotation of the lens L, enabling the lens to be turned about its blocking axis, which is generally normal to the general plane of the lens;
- reproduction, consisting in relative transverse movement of the lens L (i.e. in the general plane of the lens) towards and away from the grindwheels, thus enabling the various radii describing the outline of the shape desired for the lens L to be reproduced;
- transfer, consisting in the lens L presenting axial movement (i.e. perpendicular to the general plane of the lens) relative to the grindwheels 14, thus enabling the lens L and the selected shaping grindwheel to be brought into register, and during machining, enabling the trajectory of the bevel, the groove, or the chamfer to be followed; and
- retraction, consisting in the finishing module 25 moving transversely relative to the lens L in a direction distinct from the reproduction direction, enabling the finishing module 25 to be put both into its utilization position and into its stowage position.

In this context, the general object of the invention is to integrate in the grinder a function of restarting work on the periphery of an ophthalmic lens L that has already been shaped.

Figure 3:
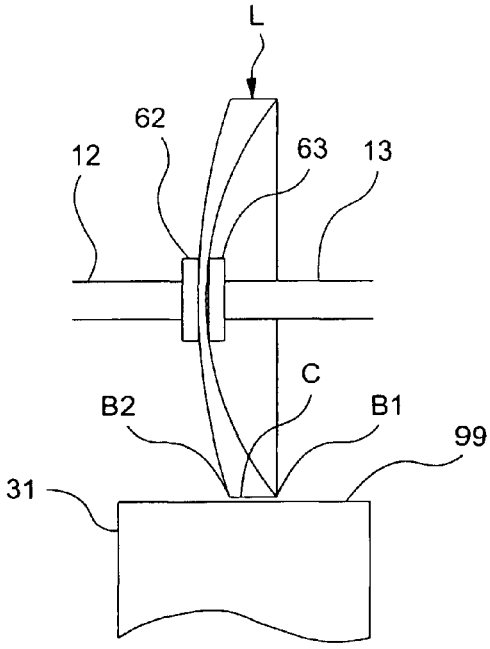
FIG. 3 is a diagrammatic view of the ophthalmic lens and of its clamping shaft ideally positioned relative to the first grindwheel.

FIG. 3 shows the ophthalmic lens L blocked by its clamping shafts 12 and 13 and facing a first grindwheel for restarting edging of the edge face C of the lens, which grindwheel is referred to as the reworking grindwheel 31. In FIG. 3, the lens L is ideally centered so that its edge face C is parallel to the edging face 99 of the reworking grindwheel.

In practice, after first machining, the lens L is unblocked so its centering frame of reference is lost. Thereafter, prior to second machining, the lens L is centered and blocked again.

However, because the centering frame of reference of the first machining has been lost, there is always a centering difference between the first and second machining operations. This difference leads to the lens L tilting, and causes an error in the positioning of the edge face C of the lens L relative to the edging face 99 of the reworking grindwheel 31 (FIGS. 4 and 5).

As shown in the schematic diagram of FIG. 6, the general principle of the solution provided by the invention consists in mounting the reworking grindwheel 31 on a rotary drive support 38 by means of a spherical mechanical connection.

As shown diagrammatically in FIG. 1, the finishing module 25 of the grinder 10 has a tool 30 for working the periphery of the ophthalmic lens L. This tool is mounted on the finishing module 25 of the device 10 for shaping the ophthalmic lens L. In addition, the finishing module 25 receiving the work tool 30 is retractable in a plane extending substantially transversely to the axis A2 of the clamping shafts 12, 13 that also serve to drive the ophthalmic lens L in rotation.

Thus, the work tool 30 also possesses a retraction degree of freedom in movement ESC. The work tool 30 is rotated about its axis of rotation A4 by a motor (not shown).

The axis A4 of the work tool 30, mounted on the finishing module 25, is inclined relative to the axis A3.

To rework edging after a first machining operation, the work tool 30 includes the edging reworking grindwheel 31 that has an edging face 99 that is a surface of revolution about an axis of revolution, a second grindwheel, already known in itself, referred to as a grooving grindwheel 35, and a third grindwheel referred to as a finishing grindwheel 34.

Clearly, if the edging face 99 of the reworking grindwheel 31 is cylindrical, like the edging faces of the main grindwheels 14, inclining the tool leads to the edging face 99 of the reworking grindwheel 31 being inclined relative to the edge face C of the lens L. The error in positioning the reworking grindwheel relative to the lens is then very great.

Consequently, in order to have an edging face 99 that is as parallel as possible to the edge face C of the lens L, the edging face 99 of the reworking grindwheel 31 is conical. More precisely, the cone angle corresponds substantially to the angle of inclination of the tool 30.

In addition, as shown in FIG. 3, the reworking grindwheel 31 has two chamfering faces 33, 98 presenting generator lines that form an angle relative to the edging face 99. These chamfering faces are for chamfering the two sharp edges B1, B2 of the edged ophthalmic lens L.

In particular, the reworking grindwheel 31 also has on its edging face 99 a beveling groove 32. This groove is for reworking the edging of the edge faces of lenses that have a bevel.

In FIGS. 1 and 2 showing the shaper device 10 and the tool 30, a comparison between the reworking grindwheel 31 mounted on the tool 30 and the main grindwheels mounted on the set of grindwheels 14 shows that the diameter of the reworking grindwheel 31 is smaller than the diameter of the main grindwheels of the set of grindwheels 14. Use of the reworking grindwheel 31 is characterized by a diameter that is smaller than the diameters of the main grindwheels of the set of grindwheels 14 and serves to reduce the shear on the bevel of the lens L that appears when working on the periphery of the lens L with one of the main grindwheels of the set of grindwheels.

The reworking grindwheel 31 is mounted on the support 38 by tilting mechanical connection means that enable the reworking grindwheel 31 to pivot relative to the support 38 about two distinct pivot directions extending substantially transversely to the axis of symmetry of the edging face 99 of the reworking grindwheel.

The reworking grindwheel 31 includes a spherical connection that is radially-rigid. When the reworking grindwheel 31 is subjected to a thrust force on its edging face 99, the radially-rigid spherical connection prevents the reworking grindwheel 31 from moving in translation radially relative to the drive support 38.

In addition, the working tool 30 includes means for returning the reworking grindwheel 31 into a return position about its pivot direction. This return position for the reworking grindwheel 31 is such that the axis of symmetry its edging face 99 coincides with the axis of rotation A4 of the reworking grindwheel.

Preferably, the support 38 constitutes a drive shaft for the reworking grindwheel 31 having an axis of rotation that coincides substantially with the axis symmetry of the edging face 99 of the reworking grindwheel 31.

To drive the reworking grindwheel 31 in rotation, drive means are provided for transmitting torque from the support 38 to the reworking grindwheel 31. These drive means coincide with the tilting mechanical connection means and are arranged to provide a spherical mechanical connection with a finger that prevents the reworking grindwheel 31 from turning about its axis of symmetry A4 relative to the support 38.

FIG. 7 shows a first embodiment of the invention of a tool 30A. In particular, the spherical mechanical connection with a finger comprises firstly a fluted ball 40 secured to the support 38 with a pin 50 for preventing rotation, and presenting a plurality of rounded faces, and secondly a fluted housing 70 associated with the reworking grindwheel 31A, presenting a plurality of faces and arranged to co-operate with said fluted ball 40.

More precisely, the ball 40 and the housing have faces oriented in the direction of the axis of rotation A4 of the reworking grindwheel 31A. These faces prevent the reworking grindwheel 31A from turning about the axis A4 relative to the support 38 on which it is mounted. This blocking of the reworking grindwheel in rotation relative to the support then enables torque to be transmitted from the support 38 to the reworking grindwheel 31A. Torque transmission drives the reworking grindwheel in rotation about the axis of rotation A4. Advantageously, the curved faces of the ball 40 leave the reworking grindwheel 31A free to turn with two other degrees of freedom in rotation, thus always enabling it to adapt well to the edge face C of the ophthalmic lens L to be reworked.

In particular, in this embodiment, the reworking grindwheel 31A has a ring 45 presenting an outside face constituting the edging face 99A. The ring 45 of the reworking grindwheel 31A is mounted on another ring made up of two portions 41 and 42 with an inside face including fluting for co-operating with the fluted ball 40.

The two portions of the ring are interconnected by two screws 43 and 44. Assembling the two portions of the ring together with the help of two screws helps mitigate the problem of mounting the reworking grindwheel 31A on the ball 40.

In order to prevent the reworking grindwheel 31A from moving axially relative to the ball 40, the fluted housing 70 of the reworking grindwheel 31A is of reduced diameter at its ends so as to form stop shoulders 71 and 72 that prevent the reworking grindwheel 31A from moving relative to the ball 40. The shoulders 71 and 72 of the housing possess a plurality of rounded faces of shape that match those of the rounded faces of the ball 40 so as to allow the reworking grindwheel 31A to pivot about its pivot axes through a certain pivot angle.

In this embodiment, the reworking grindwheel 31A possesses free angular clearance about its two pivot directions. Consequently, the reworking grindwheel 31A is returned angularly to its return position solely by the reworking grindwheel rotating about its axis of rotation A4, under the effect of centripetal inertial forces.

For assembly considerations, a spacer 51 is placed between the reworking grindwheel 31A and the rotary drive shaft 37 to the right of the ball 40 in FIG. 7, so as to constitute an abutment for the various elements that might prevent the reworking grindwheel 31A from tilting about its pivot axes.

After all of the elements constituting the work tool 30A have been placed on the drive shaft 37, the various elements placed on the work tool 30A are clamped together with a screw 36 and a washer 23. The screw co-operates with a tapped hole formed in the end of the shaft 37 of the work tool 30A.

It is of interest to observe that since the return force is due to solely to the inertial force of rotation, it is preferable to have a reworking grindwheel 31A that is well balanced.

FIG. 8 shows a second embodiment of a work tool 30C. This embodiment is a variant of the above-described embodiment. To ensure continuity from one embodiment to another, elements that are identical or similar between the various embodiments of the invention are referenced using the same reference signs. Thus, there can be seen the grooving grindwheel 35 mounted on the support 38 by means of the ball 40 and the rotary stop pin 50, the rotary drive shaft 37, the screw 36, and its washer 23.

This tool 30C comprises a reworking grindwheel 31C made differently than in the above-described embodiment. For assembly purposes, a spacer 55, 56 is placed between each resilient gasket 47, 48 and the drive shaft 37. The spacers 55, 56 then act as shoulders for the various elements distributed on either side of the reworking grindwheel 31C on the tool 30C.

The return means for the reworking grindwheel are resilient. More precisely, these means comprise two resilient gaskets 47 and 48 that are axially and/or radially compressible mounted on the axis of rotation A4. Each gasket possesses an edge bearing against the corresponding flank of the reworking grindwheel 31C and an opposite edge bearing against an associated abutment of the spacers 55, 56. By way of example, the two resilient gaskets 47 and 48 are made of elastomer. The return force due to these resilient return means is then additional to the return force due to the centripetal inertial force that arises when the reworking grindwheel is set into rotation about its axis of rotation.

In this embodiment, unlike in the first, the fluted housing 75 of the reworking grindwheel 31C does not have portions that close around the ball 40. In the first embodiment, the enclosed portions of the housing act as shoulders for the axial abutment for preventing the grindwheel moving relative to the ball. In this embodiment the reworking grindwheel 31C is prevented from moving axially by the gaskets 47 and 48.

FIG. 9 shows a third embodiment of a work tool 30B. This embodiment is a variant of the preceding embodiment. For clarity between embodiments, elements that are identical or similar between the various embodiments of the invention are referenced by the same reference signs. Thus, there can be seen the grooving grindwheel 35 mounted on the support 38 by the ball 40 and the rotary stop pin 50, the rotary drive shaft 37, the screw 36, and its washer 23.

The tool 30B has a reworking grindwheel 31B made differently than in the preceding embodiment. The space around the reworking grindwheel 31B is optimized by mounting a resilient return gasket 46 on one side only of the ball 40. As in the preceding embodiment, for assembly reasons, a spacer 53 is placed between the reworking grindwheel 31B and the rotary drive shaft 37 on the right of the ball 40 in FIG. 9 in order to constitute an abutment stopping the various elements that might oppose tilting of the reworking grindwheel 31B about its pivot axes.

As in the preceding embodiment, the resilient gasket 46 is axially and/or radially compressible. This gasket is mounted on the axis of rotation A4 and possesses an edge bearing against the corresponding flank of the reworking grindwheel 31B and an opposite edge pressing against an abutment associated with the spacer 53. This resilient gasket 46 is made of elastomer, for example.

The reworking grindwheel 31B is prevented from moving axially in one direction only by the resilient gasket that is placed on one side only of the ball. This resilient gasket forms an axial abutment in one direction (to the right in FIG. 9). To stop the reworking grindwheel 31B from moving in axial translation in the opposite direction, the fluted housing 74 of the reworking grindwheel 31B is made to have a smaller diameter at its end beside the resilient gasket 46 so as to form a stop shoulder 73 for stopping the reworking grindwheel 31B from moving relative to the ball 40. The shoulder 73 possesses a plurality of rounded faces of shape that matches the shape of the rounded faces of the ball 40 so as to allow the reworking grindwheel 31B to pivot about its pivot axes through a certain pivot angle.

It should be observed that it is necessary to use a resilient gasket that delivers pressure that is twice that of the preceding embodiment, since this gasket needs to perform the same work as the two resilient gaskets disposed on either side of the ball in that embodiment.

FIG. 10 shows a fourth embodiment of a work tool 30D. This embodiment is a variant of the preceding embodiment. For continuity from one embodiment to another, elements that are identical or similar between the various embodiments of the invention are referenced by the same reference signs. Thus, there can be seen the grooving grindwheel 35 carried by the support 38 by the ball 40, the rotary drive shaft 37, the screw 36, and its washer 23.

The tool 30D has a reworking grindwheel 31D that is made differently than in the preceding embodiments. The reworking grindwheel 31D is made in the form of a ring 49. The spherical mechanical connection means with a finger comprise an internal collar 39. The collar 39 is secured to the reworking grindwheel 31D. The collar is situated in the plane perpendicular to the axis of revolution of the reworking grindwheel 31D, centered on the axis of symmetry and substantially at the center of the width of the grindwheel.

The internal collar 39 co-operates with the support via contact that is linear or substantially multi-point. This type of contact between the drive support 38 and the collar 39 of the reworking grindwheel 31D serves to provide a double pivot connection. This double pivot connection allows the reworking grindwheel 31D to pivot about axes perpendicular to its axis of rotation A4. In addition, the stiffness of the collar 39 disposed at the center of the reworking grindwheel 31D gives the grindwheel a certain amount of radial stiffness.

In this embodiment, the return means for returning the reworking grindwheel 31D to its return position comprise at least two resilient bodies 91 and 92 mounted on either side of the central collar 39 of the reworking grindwheel. These bodies 91 and 92 co-operate firstly with the support 38 and secondly with the ring 49.

To provide this co-operation, the support 38 and the ring 49 forming the reworking grindwheel 31D are provided with arrangements 80, 81, 82, 83, e.g. notches, that hold portions of the resilient bodies captive in the support 38 and in the ring 49 of the grindwheel. These arrangements 80, 81, 82, 83 hold the resilient bodies 91, 92 in place relative to the ring 49 and the support 38. Thus, the arrangements 91, 92 prevent the ring 49 and the central collar 39 secured thereto from turning relative to the support. The resilient bodies then transmit torque from the support 38 to the reworking grindwheel 31D.

The resilient bodies 91 and 92 can be put into place on either side of the central collar 39 by casting these resilient bodies. By way of example, the resilient bodies are made of elastomer.

Thus, the edging face 99D of the reworking grindwheel 31D can be pushed back by bearing against the resilient bodies 91, 92 on either side of the collar 39. This facility for being pushed back elastically at its edges, in association with the double pivot connection of the collar 39 gives the reworking grindwheel 31D the desired ability to move in tilting so as to adapt to the edge face C of the lens L for edging.

In a variant (not shown) of the above-described embodiments, it is possible to envisage using an anisotropic elastomer possessing properties of elastic deformation on its edges, in association with elastic deformation that is practically zero on a central plane of the elastomer. This practically zero elastomer deformation along a central plane serves to provide a spherical connection that is radially rigid.

In another envisaged variant of the invention (not shown), the drive means for the reworking grindwheel are distinct from the tilting mechanical connection means. The side faces on either side of the reworking grindwheel have a dished shape. The reworking grindwheel is held by support arms disposed on either side of its side faces. These arms hold the reworking grindwheel like a clamp. For this, they make use of pointed endpieces disposed at the end of the support arms. These endpieces press against the centers of the side faces of dished shape.

In this configuration, resilient bodies are disposed between the support arms and the side faces of the reworking grindwheel in order to provide a resilient return force. The reworking grindwheel is thus free about its free axis of rotation. The reworking grindwheel can then be driven in rotation by drive means that co-operate with one of the outside faces of the grindwheel, e.g. by means of a dog clutch.

The edger device 10 and its work tool 30 (or one of the variant work tools 30A; 30B; 30C; 30D) of the invention are advantageously used for implementing a method of working the periphery of the ophthalmic lens L.

Advantageously, the method of reworking edging of the periphery of the ophthalmic lens L is applied to reworking the edging of the edge face C of the ophthalmic lens L by machining it after a first machining operation.

Before reworking the ophthalmic lens L, the lens is subjected to feeling. This feeling of the lens L serves to position the reworking grindwheel in register with the lens for shaping.

Before the first machining operation, the lens L is centered and blocked in a first centering frame of reference by means of two blocking chucks 62, 63. Optical measurements provide an ideal frame of reference for centering the ophthalmic lens L in the clamping shafts 12, 13. Inaccuracies in the blocking of the lens L mean that the real first frame of reference obtained for centering the lens L relative to the clamping shaft 12, 13 is slightly different from the theoretical frame of reference calculated by optical measurements. The first machining operation is actually performed in this real first frame of reference.

The lens L is then shaped by machining using the cylindrical main grindwheels for roughing-out and finishing in the set of grindwheels 14. The edging faces of these main grindwheels are parallel to the axis A2 of rotation of the clamping shafts 12, 13 holding the lens L.

After this first machining operation, the lens L is unblocked, i.e. it is separated from the blocking chucks on the clamping shafts 12, 13. As a result of this unblocking, the real first frame of reference used for centering is lost.

When it is found that the edging previously performed on the lens L in the first machining operation does not provide the desired result, the optician restarts shaping the edge face C of the lens L in a second machining operation.

In order to restart machining correctly, it is necessary to place the lens L in the same real frame of reference that was used for centering it during the first machining operation so that the edging face 99 (or one of its variants 99A; 99B; 99C; 99D) of the grindwheel that was used is indeed parallel to the edge face C of the lens L that is to be reworked.

Before the second machining operation, optical measurements are used to redetermine the theoretical frame of reference for centering the lens L. Inaccuracies in these optical measurements mean that the centering frame of reference in this second machining operation differs slightly from the first theoretical frame of reference as used during the first machining operation. Furthermore, these optical measurement inaccuracies are additional to inaccuracies in blocking the lens L. The second frame of reference that is obtained for centering purposes is thus different from the first frame of reference which it is desired to recover for reworking purposes. This results in a positioning error of the lens L relative to the reworking grindwheel during this second machining operation. In particular, since the lens L is off-center relative to its center position during the first machining operation, the edge face C of the lens L is inclined relative to the edging face 99 (or one of its variants 99A; 99B; 99C; 99D) of the reworking grindwheel. Thus, machining in this configuration cannot enable the desired radii of curvature to be obtained at the edge face of the lens.

The second machining operation is thus performed with the reworking grindwheel 31 (or one of its variants 31A; 31B; 31C; 31D) for performing edging. The reworking grindwheel is then positioned at the edge face C of the lens L for edging by using the retraction degree of freedom in movement ESC of the finishing module 25 in a plane that extends transversely to the clamping shafts 12, 13 clamping the lens L.

During this reworking of edging, use is made of the freedom of the reworking grindwheel 31 (or one of its variants 31A; 31B; 31C; 31D) to tilt about its two pivot axes.

Because of this freedom to move in tilting, when the lens L is put into contact with the edging face 99 (or one of its variants 99A; 99B; 99D; 99D) of the reworking grindwheel 31 (or one of its variants 31A; 31B; 31C; 31D), the edging face itself tilts to adapt to the local orientation of the edge face C of the lens L.

The ability of the reworking grindwheel 31 (or one of its variants 31A; 31B; 31C; 31D) to move in tilting is of the spherical type, being radially rigid. When a bearing force is exerted by the lens L on the reworking grindwheel, this radial rigidity enables the reworking grindwheel to avoid moving radially relative to the support 38. A radial movement of the grindwheel relative to the support 38 would change the dimension to which the lens is being machined. However machining dimensions need to be complied with as accurately as possible in order obtain the desired radius at the edge face C in question that is being reworked.

During this second machining operation on the edge face C of the lens L, the reworking grindwheel 31 (or one of its variants 31A; 31B; 31C; 31D) is returned towards its return position in pivoting about its pivot directions so that the edging face 99 (or one of its variants 99A; 99B; 99C; 99D) of the reworking grindwheel remains parallel to the edge face C the lens L for edging. This return may be the result of the inertial force due to the reworking grindwheel being driven in rotation. This inertial force ensures that the reworking grindwheel tends naturally to put itself back in a plane perpendicular to its axis of rotation A4 while following the edge face C of the lens by making use of its two degrees of freedom in tilting about the axis of rotation A4.

This return of the reworking grindwheel 31 (or one of its variants 31A; 31B; 31C; 31D) to its return position can also be achieved with the help of elastic means. Under such circumstances, the inertial force due to rotary drive is additional to the resilient return force.

Furthermore, the beveling groove 32 (or one of its variants 32A; 32B; 32C; 32D) in the edging face 99 (or one of its variants 99A; 99B; 99C; 99D) of the reworking grindwheel 31 (or one of its variants 31A; 31B; 31C; 31D) makes the method of working the periphery of the lens L applicable to edging the edge face C of ophthalmic lenses L that have a bevel.

Furthermore, the chamfering face 33, 98 (or one of its variants 33A, 98A; 33B, 98B; 33C, 98C; 33D, 98D) of the reworking grindwheel 31 (or one of its variants 31A; 31B; 31C; 31D) makes it possible to perform a step of chamfering the sharp edges B1, B2 at the edges of the lens L by means of said grindwheel.

The way in which the reworking grindwheel 31 (or one of its variants 31A; 31B; 31C; 31D) is mounted on its support 38 via a spherical connection optimizes this chamfering step. To perform chamfering correctly account needs to be taken of the fact that the width of the chamfer is proportional to the machining force, so it is necessary to avoid variations in the machining force.

The ball mounting of the reworking grindwheel 31 (or one of its variants 31A; 31B; 31C; 31D) makes the grindwheel flexible. Having flexibility in the reworking grindwheel serves to absorb variation in thrust pressure during the chamfering step. The flexibility of the grindwheel thus serves to exert a regular thrust force from the lens on the grindwheel and to have a chamfer of regular width.

Finally, the grooving grindwheel 35 of the tool 30 (or one of its variants 30A; 30B; 30C; 30D) for working the periphery in accordance with the invention enables a grooving step to be performed on the lens L. In particular, when a groove is made with the grooving grindwheel in the edge face C of the lens L, the groove needs to follow a desired axial curvature in the edge face C of said lens L, depending on the shape of the frame.

Ideally, the outside portion of the grooving grindwheel 35 used for grooving the edge face C of the lens needs to be tangential to the desired curvature. That is to say the grooving grindwheel 35 should have inclination that adapts to the curvature of the groove desired in the lens L. Unfortunately, the orientation of the grooving grindwheel 35 relative to the ophthalmic lens L is fixed.

Consequently, assuming that the axis of rotation A4 of the grooving grindwheel is parallel to the axis of the lens L, the grooving grindwheel will be biased relative to the shape desired for the groove over at least a portion of the outline of the lens. This bias leads to a groove of width that varies depending on the angle between the grooving grindwheel and its path. This groove is the result of accumulating bias grooves at each groove point in the edge face C of the lens L, in the manner of a snow plow.

To mitigate this machining difficulty, at least in part, the lens L is advantageously grooved with the tool 30 (or one of its variants 30A; 30B; 30C; 30D) being inclined by about 15°, and thus with the axis of rotation A4 being inclined by that amount in the plane under consideration. This serves to improve the regularity of the width of the groove all along the edge face C of the lens L.

The present invention is not in any way limited to the embodiments described and shown, and the person skilled in the art can make any variation thereto in accordance with the spirit of the invention.

The work tool comprising the reworking grindwheel can also be used for reworking the edging of a lens on which a centering-and-drive pad is applied. The reworking grindwheel enables edging of the lens to be restarted in spite of the pad secured to the lens being subject to dispersion in its positioning relative to the shafts for clamping the lens and driving it in rotation.

The invention claimed is:

1. A method of working the periphery of an ophthalmic lens (L), the periphery of the lens (L) possessing an edge face (C) and the method including edging the edge face (C) of the lens (L) by machining with a first grindwheel (31; 31A; 31B; 31C; 31D) mounted to rotate about an axis of rotation (A4), the method being characterized in that, during the edging, in addition to being free to rotate about said axis of rotation (A4), the first grindwheel (31; 31A; 31B; 31C; 31D) possesses two degrees of freedom to move in tilting about two distinct pivot directions that are substantially transverse to its axis of rotation (A4).

2. A method according to claim 1, characterized in that the freedom to move in tilting of the first grindwheel (31; 31A; 31B; 31C; 31D) is freedom of the radially-rigid, spherical type.

3. A method according to claim 1, characterized in that the first grindwheel (31; 31A; 31B; 31C; 31D) is returned in its pivoting about its pivot directions towards a return position.

4. A method according to claim 1, characterized in that it is adapted to reworking the edging of the edge face (C) of the lens (L) after a first machining operation.

5. A method according to claim 4, characterized in that it includes the following preliminary steps:

before the first machining operation, the lens (L) is centered and blocked in a first centering frame of reference;

after the first machining operation, the lens (L) is unblocked and the centering frame of reference lost; and before the second machining operation, the lens (L) is centered and blocked again.

6. A method according to claim 1, characterized in that for the first grindwheel (31; 31A; 31B; 31C; 31D) possessing a beveling groove (32; 32A; 32B; 32C; 32D) in its edging face (99; 99A; 99B; 99C; 99D), said method is applied to reworking the edging of the edge face (C) of an ophthalmic lens (L) including a bevel.

7. A tool (30) for working the periphery of an ophthalmic lens (L), the tool comprising a support (38) and a first grindwheel (31; 31A; 31B; 31C; 31D) mounted on the support (38), the first grindwheel (31; 31A; 31B; 31C; 31D) presenting an edging face (99; 99A; 99B; 99C; 99D) that is circularly symmetrical about an axis of symmetry, the tool being characterized in that the first grindwheel (31; 31A; 31B; 31C; 31D) is mounted on the support (38) by tilting mechanical connection means enabling the first grindwheel (31; 31A; 31B; 31C; 31D) to pivot relative to the support (38) about two distinct pivot directions that extend substantially transversely relative to the axis of symmetry of the edging face (99; 99A; 99B; 99C; 99D) of the first grindwheel (31; 31A; 31B; 31C; 31D).

8. A tool (30) according to claim 7, characterized in that the first grindwheel (31; 31A; 31B; 31C; 31D) includes a radially-rigid spherical connection.

9. A tool (30) according to claim 7, characterized in that the first grindwheel (31; 31A; 31B; 31C; 31D) includes a beveling groove (32; 32A; 32B; 32C; 32D) in its edging face (99; 99A; 99B; 99C; 99D).

10. A tool (30) according to claim 7, characterized in that it includes return means for returning the first grindwheel (31; 31A; 31B; 31C; 31D) to a return position about its pivot directions.

11. A tool (30) according to claim 10, characterized in that the return means comprise at least one resilient return gasket (46; 47, 48) that is axially and/or radially compressible, that is mounted on the axis of rotation (A4), and that has an edge bearing against the corresponding flank of the first grindwheel (31; 31A; 31B; 31C; 31D) and an opposite edge bearing against an abutment associated with the support (38).

12. A tool (30) according to claim 7, characterized in that the support (38) constitutes a drive shaft for the first grindwheel (31; 31A; 31B; 31C; 31D) having an axis of rotation (A4) that coincides substantially with the axis of symmetry of the edging face (99; 99A; 99B; 99C; 99D) of the first grindwheel (31; 31A; 31B; 31C; 31D), drive means being provided for transmitting torque from the support (38) to the first grindwheel (31; 31A; 31B; 31C; 31D).

13. A tool (30) according to claim 7, characterized in that the drive means coincide with the tilting mechanical connection means and are arranged to provide a spherical mechanical connection with a finger.

14. A tool (30) according to claim 13, characterized in that the spherical mechanical connection with a finger comprises firstly a fluted ball (40) associated with the support (38), and secondly a fluted housing (70; 74; 75) associated with the first grindwheel (31; 31A; 31B; 31C; 31D) and arranged to co-operate with said fluted ball (40).

15. A tool (30) according to claim 13, characterized in that for the first grindwheel (31; 31A; 31B; 31C; 31D) implemented in the form of a ring (49), the spherical mechanical connection means with a finger comprise an internal collar (39) co-operating with the support (38) via linear or substantially multi-point contact.

16. A tool (30) according to claim 15, characterized in that the return means include at least one resilient body (91, 92) mounted on at least one side of the central collar (39) of the first grindwheel (31; 31A; 31B; 31C; 31D), the body (91, 92) co-operating firstly with the support (38) and secondly with the ring (49) to transmit torque from the support (38) to the first grindwheel (31; 31A; 31B; 31C; 31D).

17. A tool (30) according to claim 7, characterized in that the drive means for the first grindwheel (31; 31A; 31B; 31C; 31D) are distinct from the tilting mechanical connection means.

18. A tool (30) according to claim 7, characterized in that the first grindwheel (31; 31A; 31B; 31C; 31D) has at least one chamfering face (33, 98; 33A, 98A; 33B, 98B; 33C, 98C; 33D, 98D) with a generator line that forms an angle relative to the edging face (99; 99A; 99B; 99C; 99D).

19. A tool (30) according to claim 7, characterized in that the edging face (99A; 99B; 99C; 99D) of the first grindwheel (31; 31A; 31B; 31C; 31D) is conical.

20. A shaper device (10) for shaping an ophthalmic lens (L), the device having shafts (12, 13) for clamping and imparting rotary drive to the ophthalmic lens (L), main (14), and a work tool (30) according to claim 7.

21. A shaper device (19) according to claim 20, characterized in that the tool (30) is disposed on a module (25) of the device (10) for shaping the ophthalmic lens (L) that is retractable in a plane that extends substantially transversely to the axis of the clamping and rotary drive shafts (12, 14) for the ophthalmic lens (L).

* * * * *

UNITED STATES PATENT AND TRADEMARK OFFICE

CERTIFICATE OF CORRECTION

PATENT NO. : 7,803,035 B2
APPLICATION NO. : 11/919422
DATED : September 28, 2010
INVENTOR(S) : Michel Nauche et al.

It is certified that error appears in the above-identified patent and that said Letters Patent is hereby corrected as shown below:

In the Claims:

In column 18, claim 20, line 30, “main” should read -- main grindwheels --.

Signed and Sealed this
Fourteenth Day of May, 2013

Teresa Stanek Rea
*Acting Director of the United States Patent and Trademark Office*